United States Patent [19]

Peterle

[11] Patent Number: 4,794,976

[45] **Date of Patent: * Jan. 3, 1989**

[54] MOLDING SAND LOADING AND INJECTING HEAD, IN PARTICULAR FOR MOLDED CORE FORMING MACHINES

[76] Inventor: Guido Peterle, Via Novara 37, 28021 Borgomanero (Prov. of Novara), Italy

[ * ] Notice: The portion of the term of this patent subsequent to Oct. 20, 2004 has been disclaimed.

[21] Appl. No.: 68,516

[22] Filed: Jun. 29, 1987

[30] Foreign Application Priority Data

May 13, 1986 [IT] Italy ..... 20405 A/86

[51] Int. Cl.[4] ..... B22C 15/24

[52] U.S. Cl. ..... 164/201; 164/202; 164/228

[58] Field of Search ..... 164/200, 201, 202, 228

[56] References Cited

U.S. PATENT DOCUMENTS

| | | | |
|---|---|---|---|
| 2,654,924 | 10/1953 | Wood et al. | 164/200 |
| 2,793,409 | 5/1957 | Hansberg | 164/201 |
| 3,225,396 | 12/1965 | Hansberg | 164/202 |
| 4,700,767 | 10/1987 | Peterle | 164/201 |

FOREIGN PATENT DOCUMENTS

| | | | |
|---|---|---|---|
| 1064696 | 9/1959 | Fed. Rep. of Germany | 164/201 |
| 3019455 | 12/1980 | Fed. Rep. of Germany | 164/200 |
| 409775 | 5/1974 | U.S.S.R. | 164/200 |

*Primary Examiner*—Nicholas P. Godici
*Assistant Examiner*—J. Reed Batten, Jr.
*Attorney, Agent, or Firm*—Guido Modiano; Albert Josif

[57] ABSTRACT

Molding sand loading and injecting head comprising a vertical cylindrical injecting chamber adapted to be placed in contact with a core box placed below the chamber and provided with an annular tank for compressed air associated with a movable-shutter device adapted to send the compressed air into the chamber both axially and transversely thereto. The head has support and guiding sleeves including an inner sleeve rigid with the chamber and an outer coaxial sleeve rigid with a supporting frame work. The head further comprises a hydraulically operated distributing valve, arranged coaxially to the chamber and associated with the compressed air distribution shutter, for vertically moving the chamber and the related shutter in both directions. The top of the chamber accommodates a coaxial tubular body which defines with the chamber an annular interspace having such dimensions as to convey both the axial compressed air and the radial compressed air along the chamber without causing vorticose motions and/or air bubbles.

1 Claim, 1 Drawing Sheet

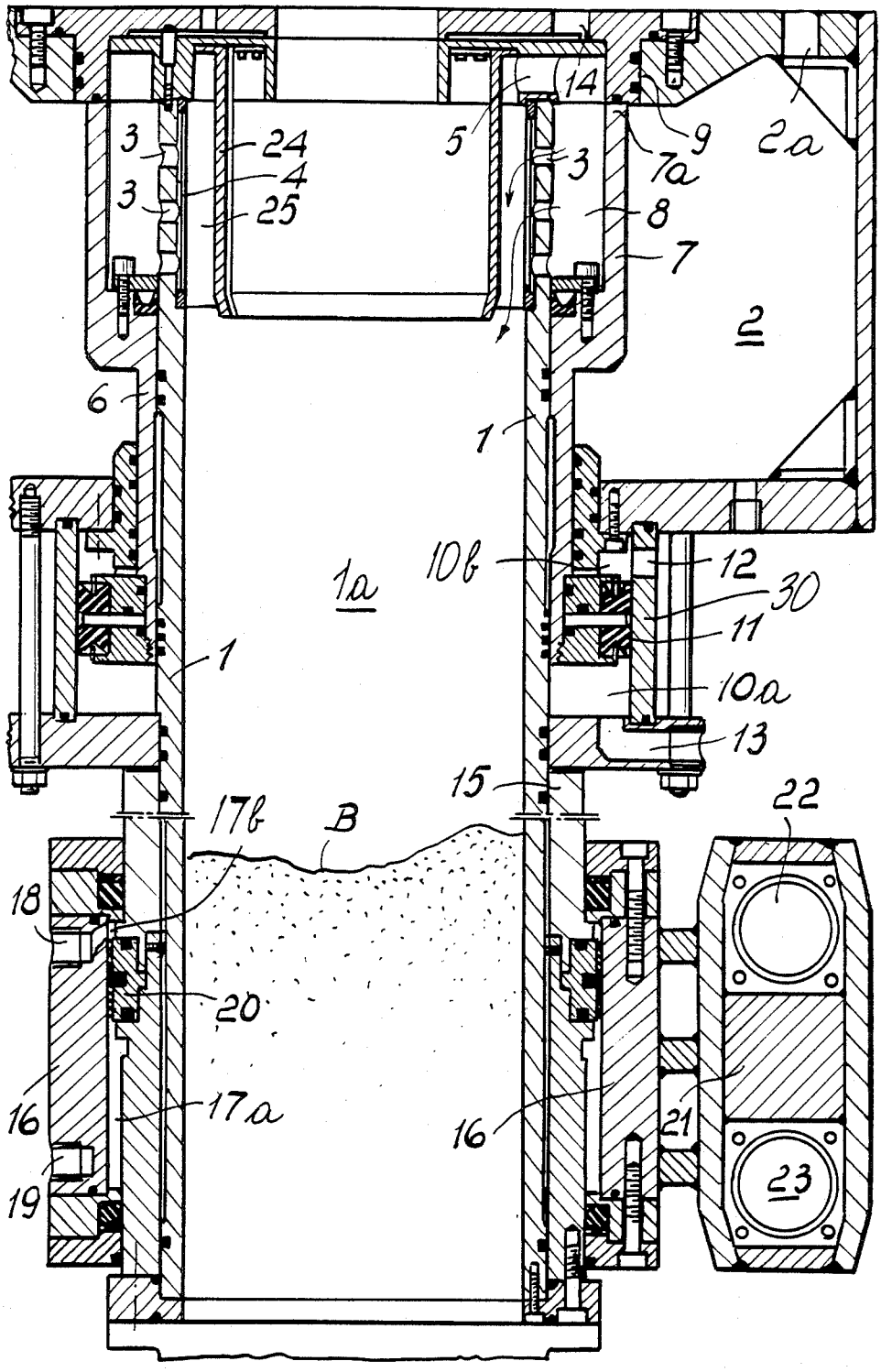
14
5
9
2a
3
24
4
3
25
3
7a
8
7
2
6
1
1a
10b
12
30
11
1
10a
13
15
22
17b
B
18
20
16
17a
16
21
19
23

MOLDING SAND LOADING AND INJECTING HEAD, IN PARTICULAR FOR MOLDED CORE FORMING MACHINES

BACKGROUND OF THE INVENTION

The present invention relates to a head for loading and injecting molding sand (sand and related additives) by means of compressed air, in machines for forming sand cores within dies or openable core boxes.

As is known, heads for loading molding sand for providing sand cores within openable dies generally consist of a cylindrical chamber with a vertical axis, downwardly coupled to a filling bracket or frame of a core box, and through which, entering from above, the molding sand is fed up to a preset level into said chamber. Once the level is reached, by injecting compressed air into the chamber the sand is rapidly and suddenly pushed, in practice shot, inside the core box, where it is compressed and compacted. At the end of the sand injecting and compaction operation, the core box is moved away and then opened, and the pressed core is extracted and moved away by various extraction and removal means.

It is also known that the use of compressed air for sand injecting along the cylindrical chamber and into the core boxes causes, especially in the injecting chamber, serious problems related to the systems used for the injection of the air, for the distribution thereof in the chamber and for its discharge after the injecting step. In particular, the occurring problems reside in the fact that harmful air bubbles form in the sand being fed, a vorticose air current arises, causing an insufficient density of the sand, and an irregular or uneven distribution of the density of the snad also occurs due to the position of the air discharging hole or holes after injecting.

In order to eliminate these serious disadvantages, various solutions have already been proposed, including discharging the air by means of discharge holes located and pointed towards the top of the head, as well as sending a greater amount of compressed air directed axially into the injecting chamber and a smaller amount thereof directed, instead, radially with respect to said chamber, through holes provided at its end.

Even these solutions, though they have improved the injecting operation and the quality of the molded cores, in practice have not completely solved the problem of the formation of air bubbles and of the regular compaction of the sand.

SUMMARY OF THE INVENTION

Therefore, the aim of the present invention is to provide a head for loading molding sand in molded core forming machines by means of compressed air, structured so as to completely eliminate the disadvantages caused by the inlet of compressed air according to the prior art and most of all such as to avoid both formation of air bubbles inside the injecting chamber and the vorticose motions of the air itself, with obvious advantages as to the regular distribution and the uniform density of the sand inside the chamber and the required compactness of the final molded product.

Another object of the invention is to provide an injecting head for molding-sand core forming machines, provided with programmed-intervention operating means, adapted to allow all the head to translate both horizontally and vertically away from and towards the underlying core box and therefore to make the core forming apparatus structurally simple, reliable and capable of producing compact and defect-free finished products in reduced times.

This aim, and other objects which will become apparent in the following description, are achieved by a molding-sand injecting head in molded core forming machines, of the type consisting of a supporting framework which supports a vertical cylindrical chamber for injecting the molding sand into a core box placed at the base of said chamber, and upwardly provided with an external cylindrical chamber containing compressed air adapted to be sent, both axially and transversely, to said chamber, by means of a movable shutter device placed coaxially to the chamber, said injecting head being provided, according to the present invention, with support and guiding means adapted to allow the alternate vertical translatory motion of the cylindrical chamber towards and away from a core box placed below said chamber, as well as operating means, substantially in the form of a hydraulically operated distributing valve, arranged coaxially with respect to said chamber and associated with said compressed air distribution shutter, for vertically moving the chamber and the related shutter in both directions, said hydraulic operating means being rigidly associated with said supporting framework, while at the top of the chamber, and coaxially thereto, a cylindrical tubular element is provided and dimensioned so as to create, between the inner surface of the chamber and the outer surface of the tubular element, an annular interspace adapted to convey, axially with respect to said chamber, both the compressed air injected at the top of the chamber and the air injected radially to said chamber.

BRIEF DESCRIPTION OF THE DRAWINGS

Further structural and functional characteristics of the injecting head, object of the present invention, will become apparent from the following description, with reference to the accompanying drawing, given only by way of non-limitative example, wherein the only FIGURE is an axial-diametral sectional view of an injecting head according to the invention, wherein the core boxes and the related means for the extraction and the removal of the molded cores have been omitted.

DESCRIPTION OF THE PREFERRED EMBODIMENT

With reference to said figure, the injecting head, according to the present invention, is of the type with a vertical cylindrical wall 1 defining a chamber 1a from the top whereof molding sand, generally sand and related additives, is introduced up to a filling level, indicatively illustrated at the line B, and is then injected or shot by means of compressed air into the ordinary core boxes (not illustrated) placed at the base and in close contact with the lower end of the wall 1. In particular, the present invention relates to a type of injecting head mounted axially movable towards and away from the underlying core box, in the cylindrical chamber 1a whereof the compressed air, fed through the cavity 2a and enclosed in a tank 2 coaxial to the upper part of said chamber, is fed in a greater amount from the top through passage holes 5 and directed axially with respect to the chamber, and, in a smaller amount, directed radially thereto through radial holes 3, protected by a cylindrical net or grid 4. The passage of the compressed air from the annular tank 2 to the interior of the chamber 1a is achieved by means of a shutter 6-7 coaxial to the chamber wall 1. The shutter consists of a cylindrical sleeve-like body including a lower portion 6, with reduced diameter, which is mounted sealingly slideable on the outer surface of the wall 1, and an upper portion 7, slideable inside the tank 2, and having a larger diameter so as to form an annular interspace 8 with the chamber wall.

Therefore, in the position of the figure, the compressed air in the tank 2 cannot flow into the interspace 8, while when the shutter is pulled down, an opening forms between the end 7*a* of the body portion 7 and the base of the fine closure cover 9 and allows the air to enter the interspace 8 and from there to flow into the chamber 1a through the holes 5 so as to move axially with respect to said chamber and to also flow through the holes 3 in a direction which is radial with respect to the chamber. The shutter is controlled by a hydraulically operated device consisting of two annular chambers 10*a*, 10*b* internally delimited by wall 1 and outwardly delimited by an annular body 30 rigidly connected to the chamber wall itself, and separated by an annular distributing valve body 11, rigidly connected to the shutter body and movable, in both directions, by injecting the pressurized control fluid alternately through the inlets 12-13.

Air discharge, after injecting and after closure of the shutter, occurs through a hole 14 provided in the cover of the chamber wall 1.

Up to now, the present heada corresponds to the one described in application Ser. No. 907,438 filed Sept. 16, 1986 and now U.S. Pat. No. 4,700,767 issued Oct. 20, 1987.

According to the present invention, in order to automatically control the axial motions both of the chamber wall 1 and of the shutter, the chamber wall 1 is mounted vertically movable with a preset stroke on a supporting framework of known type, not illustrated in detail and comprising a support 21, so as to be able to mate with the ordinary bracket of a known core box with two openable bodies, also not illustrated, and to be lifted away from said core box after forming of the core. The alternate axial movements of the chamber wall 1 are achieved by a hydraulically operated device, substantially a distributing valve device, which consists of a cylindrical sleeve 15, rigidly and coaxially associated to the outside of the chamber wall 1 and rigidly associated with the body 30 of the shutter. Outside the sleeve 15, a second sleeve 16 is coaxially and fluid-tight mounted and is shaped so as to create, between its inner surface and the sleeve 15, an annular interspace 17*a*, 17*b* alternatively supplied with pressurized control fluid through the inlet-outlet ports 18 and 19. Inside the annular interspace 17*a*, 17*b*, a protruding annular body 20, substantially a piston, is furthermore mounted, which is rigidly associated to the sleeve 15 and provided with sealing gaskets against the inner cylindrical surface of the outermost annular body 16 so as to define the two chambers 17*a*, 17*b*; the outer annular body 16 is rigidly mounted on the lateral support 21 which in turn is horizontally movable along tubular guides 22-23 so as to move the entire injecting head assembly from its work position to a lateral position, as in known injecting heads.

Therefore, taking into account that the chamber wall 1 is rigidly associated with the annular body 15 which bears the piston-like annular body 20, and that in the figure the chamber wall 1 is illustrated in raised position with respect to the underlying core box, injecting of molding sand into the core box is effected as follows:

after checking, with known means, the level B of the sand in the chamber 1*a*, pressurized fluid is injected into the interspace chamber 17*b*, through the inlet 18; the fluid moves the annular piston 20 downwards, thus pulling downwards the chamber wall 1 (and the related shutter 6-7) until it makes contact with the core box. At this point, pressurized fluid is fed into the chamber 10*b* through the inlet 12, causing the shutter to move back and compressed air to flow from the tank 2 into the chamber 1*a*, passing above the end 7*a* and through the ports 3. At the end of the injecting operation, pressurized fluid is fed into the chamber 10a through the inlet 13, thus forcing the shutter to return to its closing position. Once this closure has been performed, the entire head is lifted away from the underlying core box by sending pressurized fluid into the interspace 17*a* through the other inlet 19. Air discharge occurs through the upper outlet 14.

Again according to the invention, in order to avoid the formation of air bubbles and vorticose motions within the chamber 1*a*, a cylindrical tubular body 24 is placed coaxially at the top of the wall 1, extending inside the chamber and supported by the cover; an annular interspace 25, facing the radial holes 3, is formed between the chamber wall 1 and the outer cylindrical surface of the cylindrical body 24. An annular guide is thus provided for the inflowing air, allowing the entire amount of air injected to avoid creating harmful vorticose motions and/or air bubbles in the chamber 1a, improving operating conditions and the quality of the molded products.

Naturally, in practical embodiment, the invention as described above in a preferred embodiment is susceptible to structurally and functionally equivalent modifications and variations, without thereby abandoning the scope of the protection of the invention.

I claim:

1. A molding sand, loading and injecting head, in particular for molded core forming machines, comprising a supporting framework which supports a vertical cylindrical wall defining an inner chamber for injecting molding sand into a core box placed under said chamber, an external cylindrical chamber arranged around a top portion of said cylindrical wall containing compressed air adapted to be sent, both axially and transversely, to said inner chamber, a movable shutter device arranged coaxially and externally to said inner chamber for selectively allowing and preventing said compressing air to flow into said inner chamber, support and guiding means rigidly connected to said supporting framework, hydraulic operating means, including a hydraulically operated distributing valve, arranged coaxially to said inner chamber for vertically translating said inner chamber together with said shutter device, a cylindrical tubular body coaxially extending in said inner chamber at said top portion of said cylindrical wall, said cylindrical tubular body and said cylindrical wall defining, between each other, an annular interspace axially deviating compressed air injected at said top portion and compressed air radially injected into said inner chamber, wherein said support and guiding means comprises first and second coaxial cylindrical bodies, said first cylindrical body being rigidly connected to said cylindrical wall and said second cylindrical body being rigidly connected to said supporting framework, said coaxial cylindrical bodies forming between each other an annular interspace for an operating fluid, said interspace being divided in two separated interspace chambers by a hydraulical piston rigidly externally connected to said first cylindrical body and sealingly mounted against said second cylindrical body, said second cylindrical body having two separate inlets, selectively connected to a respective one of said interspace chambers and selectively fed with said operating fluid.

* * * * *